US006948973B1

(12) United States Patent
Hsu et al.

(10) Patent No.: US 6,948,973 B1
(45) Date of Patent: Sep. 27, 2005

(54) FLEXIBLE FLAT CABLE CONNECTOR

(75) Inventors: Chen-Yin Hsu, Jhongli (TW); Sheng-Chiu Yang, Jhongli (TW)

(73) Assignee: Chen Yin Hsu, Taoyuan (TW)

( * ) Notice: Subject to any disclaimer, the term of this patent is extended or adjusted under 35 U.S.C. 154(b) by 0 days.

(21) Appl. No.: 10/825,106

(22) Filed: Apr. 16, 2004

(51) Int. Cl.[7] ..... H01R 12/24
(52) U.S. Cl. ..... 439/495; 439/357
(58) Field of Search ..... 439/492–497, 439/357–358

(56) References Cited

U.S. PATENT DOCUMENTS 4,948,378 A * 8/1990 Hoshino ..... 439/271
5,397,247 A * 3/1995 Aoki et al. ..... 439/496
6,171,131 B1 * 1/2001 Lee ..... 439/358
6,276,958 B1 * 8/2001 Chih ..... 439/495
6,475,026 B1 * 11/2002 Tseng et al. ..... 439/495
6,666,706 B1 * 12/2003 Jones et al. ..... 439/405
6,733,326 B2 * 5/2004 Lee ..... 439/495
6,817,887 B2 * 11/2004 Jones et al. ..... 439/405

* cited by examiner

*Primary Examiner*—Truc Nguyen
(74) *Attorney, Agent, or Firm*—Troxell Law Office, PLLC

(57) ABSTRACT

A flexible flat cable connector providing reliable incorporation between a clamping member and a socket, having a clamping member to hold the coupling end of the cable in position before the clamping member to be inserted into a socket with the latter serving as the main portion of plug-in and plug-out of the entire connector; a locking plate protruding toward the socket being each axially provided on both sides of the clamping member; a hooking portion being provided on the front end of the locking plate protruding from the socket; a spring tongue being provided on the other end of the locking plate to compress the socket.

4 Claims, 5 Drawing Sheets

FLEXIBLE FLAT CABLE CONNECTOR

BACKGROUND OF THE INVENTION (a) Field of the Invention

The present invention is related to a flexible flat cable (FFC) connector, and more particularly, to one allow easy assembly and reliable connection between the clamping member and the socket.

(b) Description of the Prior Art

Among many electric installations, to facilitate manufacturing and maintenance of each component, the integral circuit is segregated into multiple primary electric function areas connected to one another; the method of plug-in and plug-out of the connector is used to constitute circuit connection among all the primary devices to not only facilitate upgrading and modification of the entire installation, but also make easier maintenance and replacement of each of those primary devices. Furthermore, many electric devices each provided with a single function may be applied in the electricity installations of similar functions. To make the applications of the electric device more adaptive, bus giving proper flexibility is usually used between the connector and the circuit board to diminish the limitation of assembly of the electric device within the electric installation.

As illustrated in FIG. 1 of the accompanying drawings, a connector is comprised of a socket 30 provided for the insertion of the FFC and also serving the main portion of continuity of plug-in and plug-out with other electric circuits. Furthermore, the FFP refers to a component provided with proper flexibility, and a connection terminal 21 is clamped at a coupling end of the FFC 10 before all the connection terminals 21 are secured in position by a terminal cabinet 20 to complete the connection of the electric circuit.

However, in the prior art, the terminal cabinet 20 is coupled to the FFC 10 by hooking up the connection terminal 21 to the terminal cabinet 20. There is the absence of any reliable coupling structure provided between the terminal cabinet 20 and the socket 30. As a result, in the process of the plug-in and plug-out of the connector, either FFC or the socket is vulnerable to fall off due to improper exercise of force.

SUMMARY OF THE INVENTION

The primary purpose of the present invention is to provide an FFC connector to achieve reliable incorporation between the clamping member and the socket. To achieve the purpose, a clamping member is used to secure the coupling end of the FFC in position before the clamping member is inserted into the socket with the latter constituting the main portion of the plug-in and plug-out of the entire connector. The clamping member is held in position by a casing and a lid while a limiting groove is each disposed on both sides of the top of the lid, and a locking plate protruding towards the socket is axially provided in the limiting groove. A hooking member is provided on one end of the locking plate protruding toward the front edge of the socket; and a spring tongue for the locking plate to compress the socket is provided at the other end of the locking plate.

DETAILED DESCRIPTION OF THE PREFERRED EMBODIMENTS

Figure 1:
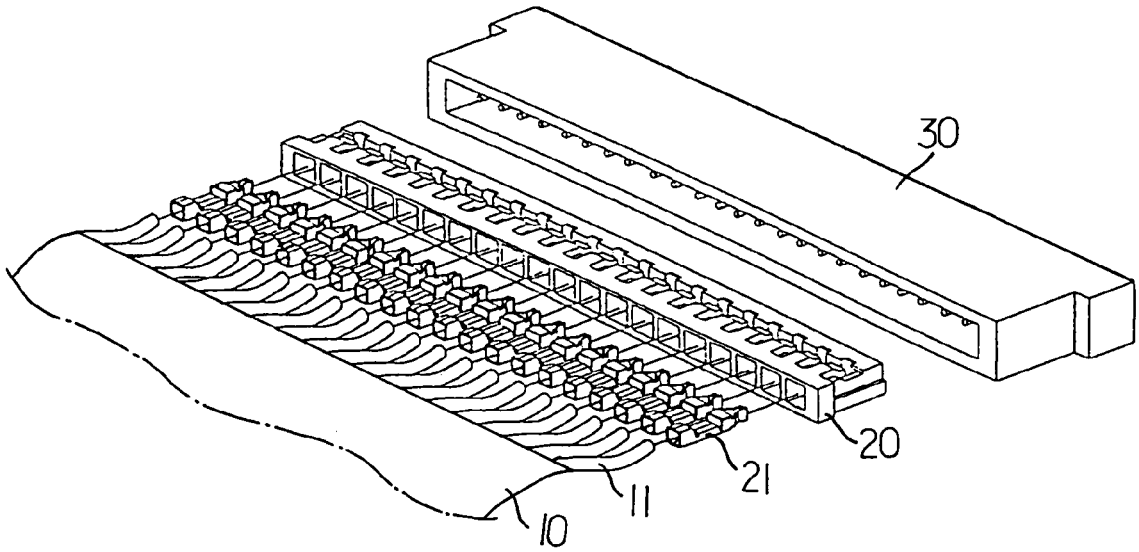
FIG.1 Prior Art
FIG. 1 is a schematic view showing a structure of an assembly of an FFC and a connector of the prior art.
Figure 2:
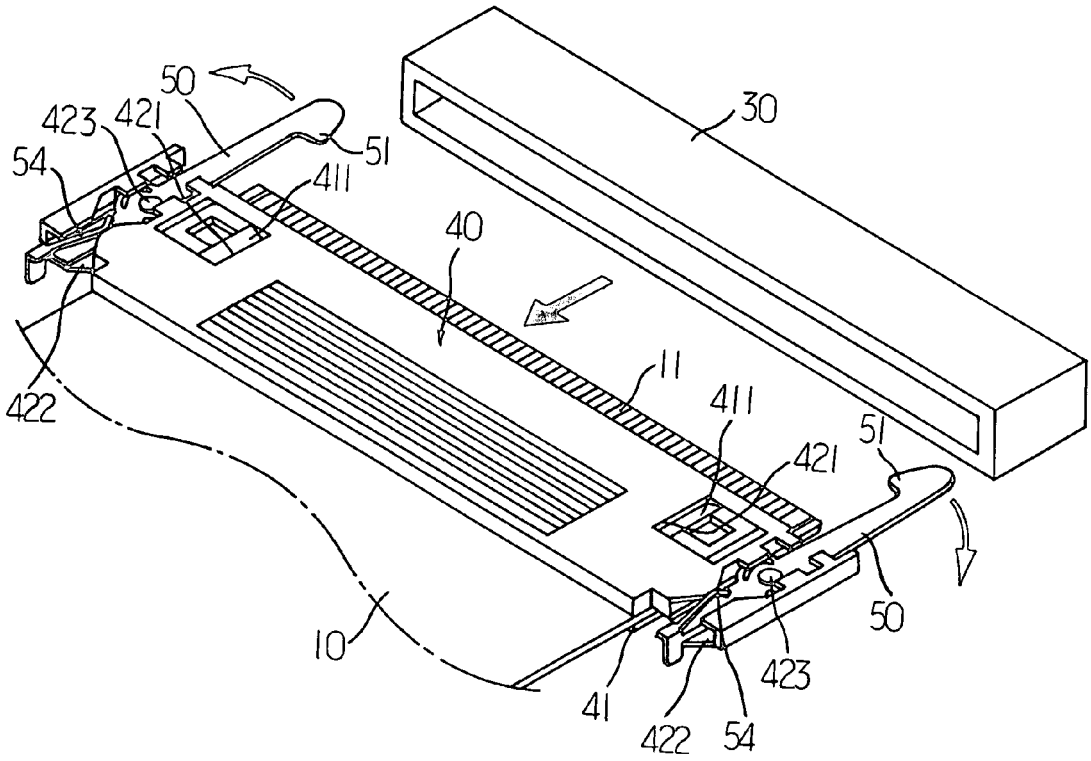
FIG. 2 is a schematic view showing a structure of an assembly between a clamping member and a socket of an FFC connector of the present invention.

Referring to FIG. 2, an FFC connector of the present invention is comprised of a clamping member 40 that holds a coupling end 11 of an FFC 10 in position before being incorporated to a socket 30 with the socket 30 serving as the main portion of the plug-in and plug-out of the entire connector.

Figure 3:
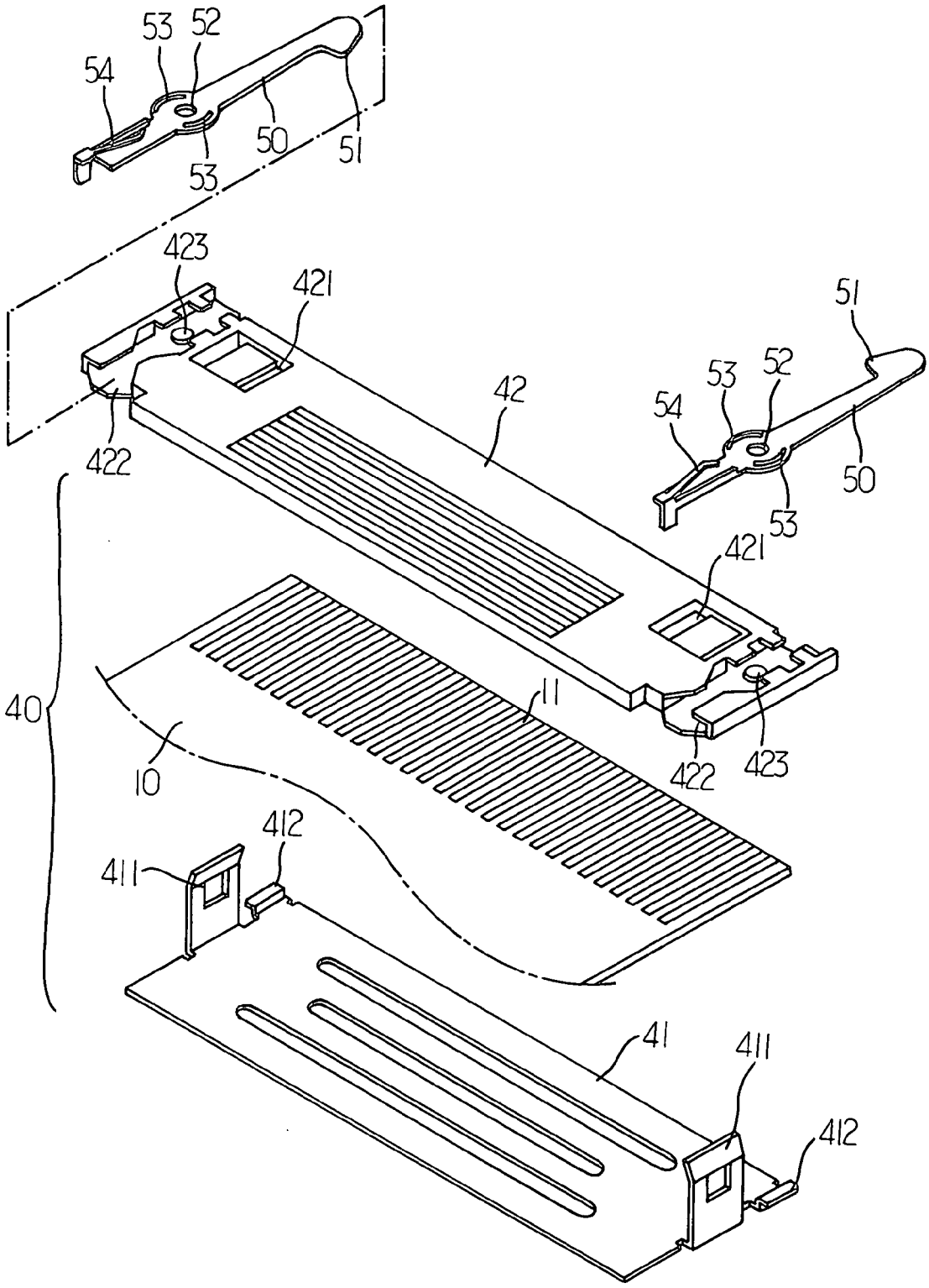
FIG. 3 is an exploded view of the structure of the clamping member of the present invention.
Figure 4:
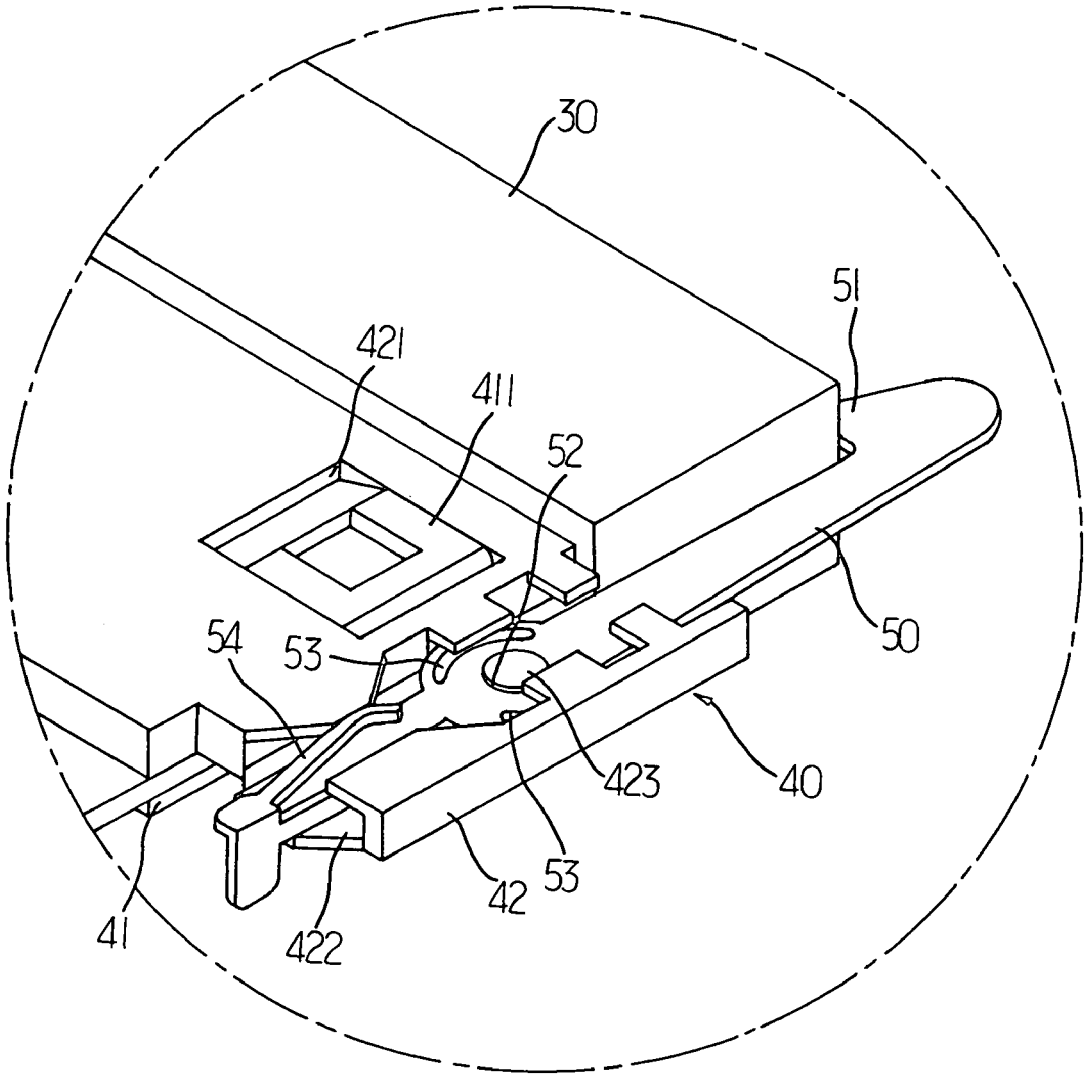
FIG. 4 is a schematic view showing the locking structure between the clamping member and the socket of the present invention.

As illustrated in FIGS. 3 and 4, the clamping member 40 holds the FFC 10 in position by a casing 41 and a lid 42. A limiting groove 422 is each provided on both sides on the top of the lid 42; a locking plate 50 protruding toward the socket 30 is axially provided in the limiting groove 422; one end of the front end of the locking plate 50 protruding out of the front end of the socket 30; and a spring tongue 54 is provided on the other end of the locking plate 50 for the locking plate 50 to compress the socket 30. Accordingly, when the clamping member 40 is inserted to the socket 30 in position, the locking plate 50 and the socket 30 are interlocked to each other to provide a reliable incorporation between both of the clamping member 40 and the socket 30.

In the preferred embodiment of the present invention, an ear 411 is each upwardly provided at a right angle from both sides of the casing 41 of the clamping member 40 while matching holes 421 are respectively provided on the lid 42 to allow insertion by the ears 411. The ear 411 passing through the hole 421 is folded toward the lid 42 for the lid 42 to be interlocked with the casing 41. The front end of the casing 41 protrudes out of the lid 42 for a given length, and a positioning portion 412 to confine the FFC 10 is each protruding upwardly from both sides of the front end of the casing 41 to firmly secure the FFC in position.

Figure 5:
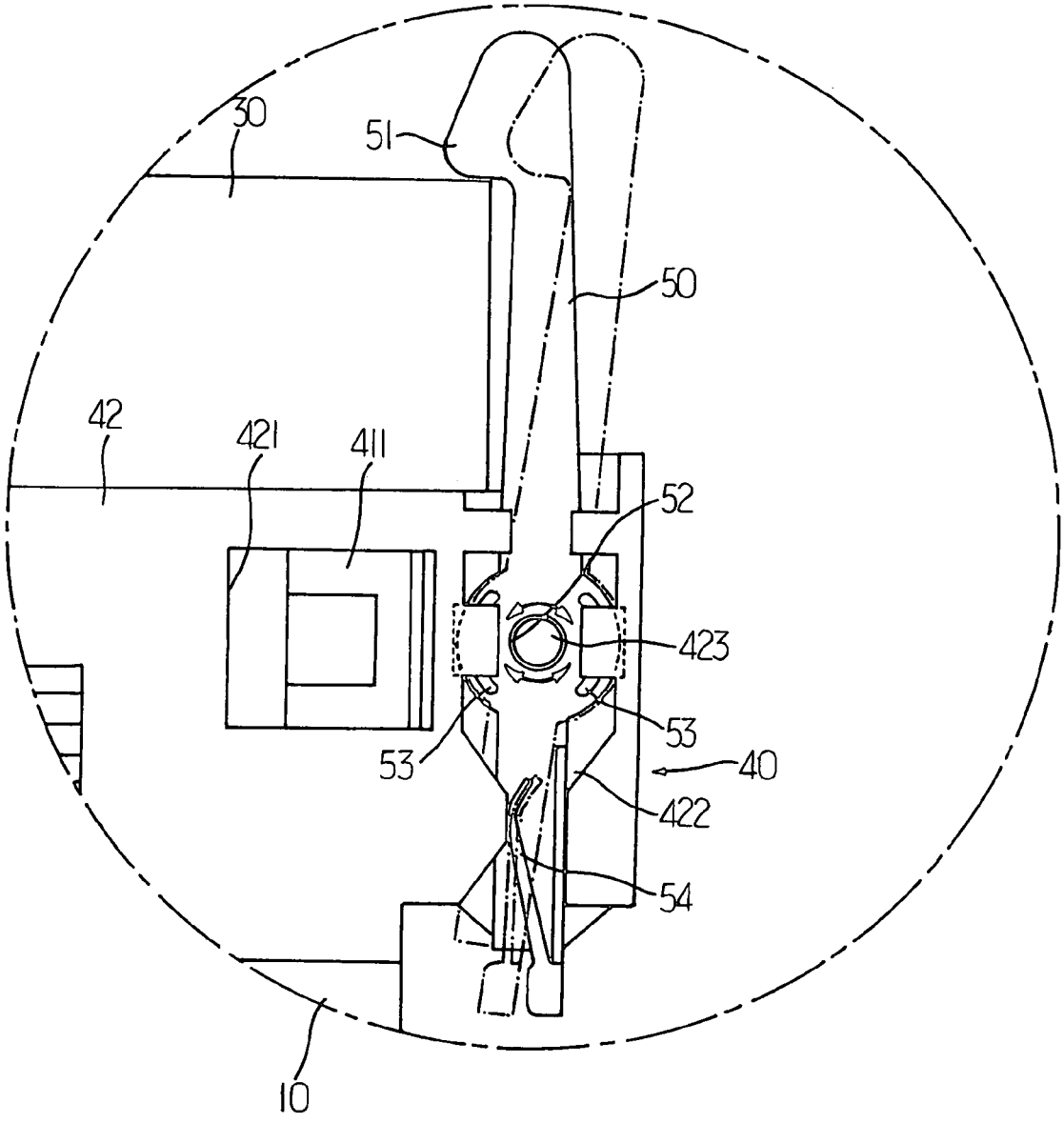
FIG. 5 is a schematic view showing how the socket is locked to the locking plate of the present invention.

Furthermore, as illustrated in FIG. 5, the lid 42 is provided with a positioning axial 423 is protruding upwardly from the middle of the limiting groove 422, and a hole 52 to receive the insertion of the positioning axial is provided on the locking plate 50. An expansion groove 53 for the expansion of the hole 52 is provided to the outer circumference of the hole 52 so to allow easy penetration of the positioning axial 423 into the hole 52 with the locking plate 50 to swing by having the positioning axial 423 as the axis, thus to permit the socket 30 to easily pass through the hooking portion 51 of the locking plate. Once the socket 30 passes through the hooking portion 51, the locking plate swings in the direction where the locking plate 50 is compressed to each other with the socket so to firmly secure the hooking portion 51 of the locking plate 50 to the front end of the socket 30 for preventing the socket 30 from falling off due to improper plug-in and plug-out.

The present invention for providing a preferred structure of an FFC connector is innovative, and this application for a utility patent is duly filed: Provided, however that it is to be noted the specification and drawings are provided as one of the preferred embodiments of the present invention and do not in any way limit the present invention. Therefore, any structure, device, and/or characteristics similar or equivalent to that of the present invention shall be deemed as falling within the scope of the purpose and claims made by the present invention.

We claim:

1. A flexible flat cable connector for a cable comprising: a clamping member to secure a coupling end of the cable in position; the clamping member being incorporated to a socket; and the socket serving as a main portion of plug-in and plug-out of the entire connector wherein a locking plate protruding toward the socket being each axially provided on both sides of the clamping member; a hooking portion being provided on one end of the locking plate protruding from the front edge of the socket; and a spring tongue being provided at another end of the locking plate to compress the socket, wherein the clamping member is comprised of a casing and a lid to secure the FCC in position; a limiting groove to receive the insertion of the locking plate is each provided on both sides of the top of the lid: a positioning axial protrudes from the middle of the limiting groove; a positioning hole to allow the insertion by the positioning axial is each provided to the locking plate; and the locking plate swings by having the positioning axial as the axis, wherein, an expansion groove for the positioning hole is provided to the external circumference of the positioning hole of the locking plate.

2. A flexible flat cable connector as claimed in claim 1, wherein, the spring tongue is integrated with the locking plate.

3. A flexible flat cable connector as claimed in claim 1, wherein, an ear is upwardly provided at a right angle each on both sides of the casing of the clamping member; a matching hole is each provided on the lid; the ear passes through the hole and is folded toward the lid for the lid to be locked to the casing.

4. A flexible flat cable connector as claimed in claim 1, wherein, the front end of the casing protrudes out of the lid for a given length and a positioning portion to limit the cable is protruding upwardly from each of two sides of the front end of the casing.

* * * * *